US006383557B1

(12) United States Patent
Smith

(10) Patent No.: US 6,383,557 B1
(45) Date of Patent: May 7, 2002

(54) PLUMBING FIXTURE SURFACE RESTORATION PROCESS

(76) Inventor: Brian K. Smith, 22895 Merriman, New Boston, MI (US) 48164

( * ) Notice: Subject to any disclaimer, the term of this patent is extended or adjusted under 35 U.S.C. 154(b) by 0 days.

(21) Appl. No.: 09/476,165

(22) Filed: Dec. 30, 1999

Related U.S. Application Data

(60) Provisional application No. 60/133,198, filed on May 7, 1999.

(51) Int. Cl.[7] ..... B05D 1/36

(52) U.S. Cl. ..... 427/140; 427/407.1; 427/407.3

(58) Field of Search ..... 427/140, 407.1, 427/407.3

(56) References Cited

U.S. PATENT DOCUMENTS 4,689,015 A * 8/1987 Denyer et al. ..... 433/217.1
4,859,491 A * 8/1989 Yan ..... 427/140
5,399,373 A * 3/1995 Mrozinski ..... 427/140
5,460,742 A * 10/1995 Cavanagh et al. ..... 252/144
6,020,028 A * 2/2000 Kinneberg ..... 427/316
6,046,295 A * 4/2000 Frisch, Jr. et al. ..... 528/28
6,187,374 B1 * 2/2001 Hardy et al. ..... 427/140

* cited by examiner

*Primary Examiner*—Shrive P. Beck
*Assistant Examiner*—Jennifer Kolb Michener
(74) *Attorney, Agent, or Firm*—Young & Basile, PC

(57) ABSTRACT

A method for restoring the outer surface of a hard substrate such as a glazed bath tub which includes the steps of cleaning and removing stains from the surface to be restored, providing a suitable dry surface for permanent application of restorative compositions, wiping a resealant composition over the dried outer surface; and wiping a glossing composition over the dried resealed outer surface. A composition suitable for cleaning the outer surface may comprise an aqueous gel and/or an abrasive. The resealant composition may comprise a water based urethane copolymer. The glossing composition may comprise a water based, metal interlocking urethane or acrylic copolymer.

15 Claims, No Drawings

PLUMBING FIXTURE SURFACE RESTORATION PROCESS

CROSS REFERENCE TO CO-PENDING APPLICATION

This application claims the benefit of the filing date of co-pending, provisional U.S. Patent Application Serial No. 60/133,198, filed May 7, 1999, in the name of Brian K. Smith and entitled "Plumbing Fixture Surface Restoration Process".

BACKGROUND OF THE INVENTION

1. Field of the Invention

The present invention relates generally to a restorative process for glossy, hard surface fixtures. More particularly, the present invention relates to such a process and compositions therefor which can be accomplished without need of respiratory protective gear or special ventilation apparatus (es) and/or spray equipment.

2. Brief Description of the Relevant Art

Bathroom and/or kitchen fixtures and the like often have a glossy or semi-glossy outer surface finish. These fixtures may include bathtubs, stall showers, sinks, water closets, countertops and the like. After years of use, the outer surfaces of these fixtures often become dulled, soiled or otherwise aesthetically displeasing. In order to improve the outer surface finish, consumers may resort to replacing the fixture(s) altogether. As can be readily appreciated, this course of action is quite costly, and may prove cost prohibitive in many cases. In addition to being costly, in the case of bathtubs, it may be almost impossible to replace the fixture. In most residential buildings, the bathtub is generally set in place before the walls, doorways, etc. are completed. As such, the finished floor plan of some residential buildings may be such that the removal of a bathtub is inordinately difficult and costly such that most residential owners would not attempt such a project.

As an alternative to replacing a fixture altogether, some consumers put a fiberglass "shell" over the original outer surface. This may solve the problem for a certain period of time; however, the fiberglass shells also become aesthetically displeasing within a relatively short period of time. As a result, in order to maintain a pleasing outer surface, the consumer may be forced to replace the fiberglass shells on a substantially regular basis. This may also be too costly a proposition in many cases.

Attempts have also been made to return the fixture to its original factory finish. These attempts generally include the spraying of harsh chemical solvents and reglazing materials having many volatile organic compounds. As such, hazardous airborne particulates may be inhaled. This requires the use of special masks and/or other respiratory gear and special ventilation in order to minimize hazardous exposure. However, even with this special gear/ventilation, many noxious fumes, particulates and the like are still inhaled. In addition to this drawback, the use of sprays for reglazing causes airborne particulates such dust, dirt or the like to be applied to the outer surface along with the glazing composition. This results in undesirable surface roughness of the article. Further, such methods generally require that the fixture not be used for at least 24–48 hours after the resurfacing—this can be an unacceptable period of "down time" in many cases.

Thus, it is an object of the present invention to provide a method for restoring the outer surface of a hard substrate such as a bathroom and/or kitchen fixture, which method advantageously is cost effective and simple. It is a further object of the present invention to provide such a method which is advantageously versatile and can be used with enamel, fiberglass, ceramic (e.g. porcelain) and other fixtures. Yet further, it is an object of the present invention to provide a method which uses materials which do not require spraying of resealant and/or reglazing compositions, thus advantageously substantially eliminating the need for special respiratory gear and/or anything other than normal ventilation. Still further, it is an object of the present invention to provide such a method which advantageously substantially eliminates the "down time" of the fixture after restoration. Still further, it is an objective of this present invention to provide a method and a process which advantageously substantially eliminates the need for expensive equipment to apply the process.

SUMMARY OF THE INVENTION

The present invention addresses and solves the abovementioned problems and meets the enumerated objects and advantages, as well as others not enumerated, by providing a method for restoring the outer surface of a hard substrate. The method comprises the steps of:

preparing the surface to be restored by contacting the surface with a composition capable of cleaning the outer surface to remove stains and altering surface characteristics of the outer surface, preferably producing an outer surface layer characterized by a porous outermost region, the prepared outer surface amenable to permanent contact by a polymeric glossing composition;

applying a resealant composition over the prepared outer surface, the resealant composition capable of penetrating and adhering to porosities created in the outer surface during the surface preparation step; and applying a glossing composition over the resealed outer surface, the glossing composition capable of essentially permanent adhesion to the applied resealant material in an essentially uniform manner.

Preferably, the various compositions such as the resealing composition and the glossing composition are applied in a thin coat by a wiping action. A composition suitable for cleaning the outer surface may comprise an aqueous gel and/or an abrasive. The resealant composition may comprise a water based urethane copolymer. The glossing composition may comprise a water based, metal interlocking urethane or acrylic copolymer.

DETAILED DESCRIPTION OF THE PREFERRED EMBODIMENTS

The method according to the present invention is useful for returning a glossy, hard surface fixture (e.g. a plumbing fixture) to substantially its factory finish without need for complicated equipment or ventilation and/or special respiratory gear (such as special masks and the like), since there are substantially no noxious odors, fumes or airborne particulates/solids. The method is cost effective, efficient, simple and requires a minimum of down time of the fixture. The method is useful on enamel, fiberglass (including fiberglass "shells"), ceramic (e.g. porcelain) and other surfaces over any type of underlying substrate. Examples of some hard surface fixtures include, but are not limited to bathtubs, stall showers, sinks, water closets, countertops and the like.

Previously, the only feasible methods for restoring the lost gloss ans stain resistance to plumbing fixtures and other surfaces involved either removal and replacement of the fixture with the glossy surface or application of paint-like material over the worn surface. Clearly, removal and replacement of the part with the worn surface is time-consuming and expensive. Application of a paint-like refinishing compound can present numerous drawbacks. Such materials can be difficult to apply. Curing or drying of the material can involve the production of noxious fumes. Paint-like materials also have relatively short duration useful lives in such settings. Such materials, once applied, are prone to chipping, staining, yellowing, and peeling after the surface has been used for a while. This leads to more expenses and complications as the repair material must be removed and the process repeated.

The present inventive method comprises the step of cleaning the outer surface to remove stains, marks, paint, dirt, grime or the like. The cleaning step may comprise the step of applying a cleaning composition to the outer surface; and, then scrubbing the outer surface with the cleaning composition. The outer surface of the substrate may preferably be rinsed with water after the cleaning step. The cleaning step also includes the step of allowing the cleaned surface to dry. Air drying may be done, however, in the preferred embodiment, the surface is blow dried with a blow dryer, heat gun and/or a fan. With blow drying, the surface may dry in a relatively short amount of time, such as about 2–3 minutes. With air drying, the surface may dry in a relatively longer amount of time, such as about 10 minutes. The cleaning composition(s) may be sprayed, rolled or squeezed from a container to the surface and then scrubbed with a brush, abrasive pad, sponge, sand paper, or the like. Up to four or more cleaning steps may be successively applied to a bad stain if desired.

It is to be understood that the cleaning composition(s) may broadly comprise any suitable composition(s). The cleaning composition, preferably, contains at least one abrasive compound. Preferably, the abrasive compound selected from the group consisting of oxalic acid dihydrate, kaolin, pumice, diatomite, tripoli, siliceous clay, silicon dioxide, and mixtures thereof. The cleaning composition also, preferably, contains at least one acidic material capable of attacking and degrading mineral deposits present on the surface to be restored. The cleaning composition is designed to be present in an aqueous solution or, at the minimum, used in conjunction with water. However, in the preferred embodiment, the cleaning composition comprises an aqueous gel and/or an abrasive. When a powder abrasive is used, water is also applied during the cleaning step with the abrasive. It is to be understood that any suitable powder or liquid abrasive(s) may be used. However, in the preferred embodiment, the powder abrasive consists essentially of oxalic acid-dihydrate. A suitable liquid or deliquescent abrasive is phosphoric acid.

An example of a suitable oxalic acid-dihydrate is commercially available from Servaas Laboratories in Indianapolis, Indiana under the trade name BAR KEEPERS FRIEND. Oxalic acid-dihydrate exhibited the following physical and chemical characteristics. It appeared as a white powder. Its solubility was 100% for acid and detergent, and its specific gravity was 88. It was a stable substance but tested incompatible with chlorine bleach and alkaline materials. Hazardous polymerization will not occur. It is not a carcinogen. No respiratory protective gear or gloves are required during use-normal local ventilation is sufficient when using oxalic acid-dihydrate.

It is to be understood that any suitable aqueous gel cleaning composition may be used. However, in the preferred embodiment, the cleaning composition comprises an aqueous gel consisting essentially of an aqueous acidic thixotropic composition having a viscosity of 2000 to 10,000 centipoise. In the preferred embodiment, the viscosity is 2500 to 7000 centipoise. The aqueous acidic thixotropic composition contains on a weight to weight basis:

- between about 0.5 percent and about 6.0 percent of a hydrated aluminum silicate substantially free from inert mineral impurities;
- between about 0.1 percent and about 3.0 percent of at least one of an amphoteric material and a highly alkoxylated block copolymer;
- between about 0.1 percent and about 5.0 percent of a nonionic surfactant selected from the group consisting of polyoxyethylene derivatives of higher alcohols and polyethylene glycol ethers of linear alcohol;
- acid present in an amount sufficient to render a pH in the range of about 0.9 to about 3.5;
- between about 5.0 percent and about 50.0 percent of an abrasive;
- between about 1.0 percent and about 20.0 percent of a cleaning solvent;
- between about 0.01 percent and about 40.0 percent oxalic acid-dihydrate ($H_2C_2O_4$-$2H_2O$) and/or phosphoric acid; and
- deionized water present in an amount sufficient to make 100 percent.

The viscosity of 2000 to 10,000 cps is sufficient to suspend abrasive particles uniformly throughout the cleaner. This viscosity is stable over a long period of time. If the viscosity is less than 2000, the formulation may be defective in that it exhibits a tendency for the settling out of the abrasive particles. If the viscosity is greater than 7000 to 10,000, the formulation may be defective in that it is more difficult to dispense as a flowable liquid. The preferred viscosity of 2500 to 7000 is sufficient to cause the formulation to adhere to a smooth vertical surface where hard water, iron and/or organic stains might be found inside of a toilet bowl, lavatory, tub, etc. The adherence of the cleaner to the vertical surfaces is important since the acid present can thereby most effectively attack the hard water and/or iron salts comprising a portion of the stains. In addition, the high viscosity keeps the abrasive agent adjacent to the stains and available for scrubbing contact therewith.

The hydrated aluminum silicate should have a cation exchange capacity of 80 to 120 meq/100 g, preferably 100 to 120 meq/100 g. Such silicate has sufficient cation exchange sites available for interaction with the amphoteric material to promote achievement and stabilization of the viscosity in the range 2000 to 10,000 cps. Any hydrated aluminum silicate, in combination with the amphoteric material, that fails this test may not be suitable for use in this invention. This requirement provides an objective test for one skilled in the art to identify useful silicates. The importance of the availability of sufficient cation exchange sites is demonstrated by the negative impact that ordinary tap water has on the viscosity of the formulations. The affinity of the exchange sites for calcium and magnesium in tap water is much stronger than the affinity for the amphoteric surfactants. Thus lower viscosity formulations are obtained when tap water is used instead of deionized water.

A highly purified grade of montmorillonite clay, having a cation exchange capacity of 100 to 120 meq/100 gin, and provided commercially as Mineral Colloid BP, is particularly useful. Other suitable hydrated aluminum silicates that can bus purified sufficiently to provide the required cation exchange capacity are well known in the art as belonging to the smectite class of clay minerals.

Amphoteric materials such as amine oxides and highly alkoxylated block copolymers are also important for establishing the desired viscosity. Amine oxide materials are preferred.

Amphoteric amine oxides stabilize viscosity and also improved the rinsability of the formulations from hard surfaces. It is believed that the amine oxide develops a slight positive charge at low pH which causes its absorption onto the hydrated aluminum silicate's surface, resulting in steric stabilization of the dispersion. Useful amine oxides are those sold under the trade name Barlox (Lonza, Inc.) and Ammonyx (Stepan Company). These compounds are representative of the broader class of alkyl dimethyl amine oxides such as lauryl dimethyl amine oxide. Also useful are alkyl amido amine oxides such as cocamidopropylamine oxide (Barlox C). Other useful amphoteric surfactants include betaine derivatives such as cocoamidopropyl betaine (Velvetex BA-35—Henkel Corp.) and cocobetaine (Mackam CB-35-Mclntyre Group Ltd.).

Useful highly alkoxylated block copolymers include those sold under the trade names PLURONICS and TETRONICS. Generically, PLURONICS polymers are $HO(CH_2CH_2O)_x(CH_3CHCH_2O)_y(CH_2CH_2O)_zH$ or $HO(CHCH_3CH_2O)_x(CH_2CH_2)_y(CHCH_3CH_2O)_zH$. TETRONICS are derived from the block copolymerization of ethylenediamine. Pluronic L92 conforms to the formula $HO(CH_2O)_x(CH_3CHCH_2O)_y(CH_2CH_2)_zH$ where the average value of x, y and z are 10, 47, and 10 respectively. It is theorized that these block copolymers do not interact ionically with the thickening system, as do the amphoteric materials, but rather through steric interaction due to their high molecular weights.

The use of an acid in the formulation is important in that it induces a change in the surface charge of the clay by lowering the pH to between about 0.9 and about 3.5. This phenomenon, which can be induced in a number of ways, causes the clay platelets to align in an edge to face manner creating a "house of cards" structure, thereby inducing an increase in viscosity. This technique is practiced by those skilled in the art of clay thickened systems. In this formula however, it is surprising that substantially no thickening occurs even with the acid if one of the important components has been excluded. This indicates a synergistic interaction between the important components that is not predictable from the individual properties of the important components. It is theorized that the surfactants interact to sterically stabilize the house of cards structure, thereby contributing to increasing the viscosity of the formulation. Useful acids include oxalic, citric, glycolic, sulfamic, hydrochloric, hydrofluoric, and phosphoric. Oxalic acid is preferred because of its capacity for rust removal and mild acid properties.

Organic solvents such as dipropylene glycol methyl ether, diethylene glycol monobutyl ether, ethylene monobutyl ether and others known by those skilled in the art of hard surface cleaner formulations can also be used. The dipropylene glycol methyl ether and the propylene glycol used in the examples function as cleaning aids. In addition to cleaning benefits, they also improve freezing stability and rinsing properties from hard surfaces. Both of these components cause a slight increase in viscosity of the formulations of the invention.

A variety of nonionic surfactants from the polyoxyethylene of higher alcohol class, such as NEODOL can be used. Found particularly suitable are polyoxyethylene derivatives of higher alcohols, such as NEODOL 23-6.5 which is based on Shell Chemical Company's primary $C_{12}$–$C_{13}$ Detergent Alcohol (NEODOL 23) and has an average of 6.5 ethylene oxide (EO) units per alcohol mole (about 59% w/w EO). Other illustrative suitable nonionic surface active agents are Union Carbide's polyethylene glycol ether of linear alcohol (9 moles EO).

The abrasive component of the formulation is useful for physically scouring the stains from surfaces. The abrasive agent should be present in amounts of from about 5 to 50% by weight of the composition. Any suitably acid stable abrasive agent may be used, although silicon dioxide is preferred because of its ready availability and low cost. The abrasive agent particle size should be quite small, i.e., from about 40 to about 400 mesh (with a preferred size being where greater than 99 percent of the particles are smaller than 325 mesh). In such a particle range, the abrasive is readily suspended in the homogenous stable liquid dispersion, yet the particles are large enough to provide adequate scouring properties. Other acid inert, abrasive agents such as, for example, kaolin, pumice, diatomite, tripoli, siliceous clay, etc., may be partially or completely substituted for the silicon dioxide. Very useful abrasive agents are silica or silicon dioxide having a median particle size of about 5.8 microns and having a particle size distribution of about 2–10 microns, e.g., Tamsil 30 (Unimin Specialty Minerals, Inc.) with a sieve analysis of 99.6% of the particles passing through a 325 mesh screen. This preferred abrasive agent in the cleanser of the invention imparts polishing but no scratching action to even delicate hard surfaces. Also acceptable for use herein is an abrasive agent of slightly larger particle size such as silicon dioxide having an average particle size up to about 10 microns and having a particle size distribution of about 1 to 40 microns, e.g., "19 Silica" (Whitaker, Clark and Daniels, Inc.) of particle size 99% less than 40 microns, 98% less than 20 microns, 77% less than 15 microns, 62% less than 10 microns, 40% less than 5 microns, 36% less than 4 microns, 22% less than 2 microns and 14 % less than 1 micron.

In addition to the above-described important components, there may be added other adjuvants which contribute desirable properties to the cleanser and which do not detract from the cleansing or polishing properties of the formulation or lessen its stability. For example, fragrances, dyes, fluorescent materials, propellants (for preparing pressurized compositions), and other compatible additional materials for furthering or enhancing the action of any of the important ingredients may be added, provided they would not detract from the desired properties of the cleanser in the relatively minor amounts in which they would be used.

Other suitable examples of aqueous gel formulations may be found in U.S. Pat. No. 5,460,742, which is incorporated herein by reference in its entirety.

A pH neutralizer is, preferably, applied after cleaning. The pH neutralizer is applied in an essentially even thin layer. The pH neutralizer may be applied by any suitable means such as wiping or pouring, however the preferred method of application, the pH neutralizer is preferably applied by spraying an aqueous material onto the surface of the material using a spray bottle or other suitable atomizer device in order to restore the pH to a favorable level at or approaching neutral. In the preferred embodiment of the present invention, the pH neutralizer solution comprises an alkaline agent and water. Suitable alkaline agents include materials such as soda ash which is preferably employed in an amount of at least 2 oz per 8 oz water. Other suitable materials can include materials such as soda bicarbonate and the like.

The pH neutralizer solution is allowed to dwell on the surface to be restored for an interval sufficient for the alkaline mater present in the solution to neutralize any acidic components which may remain on the surface of the material to be restored. In the preferred embodiment, this interval is between about 2 and about 7 minutes. After neutralization, the surface is rinsed thoroughly and is allowed to dry either by air drying or by forced air.

It is believed that after the cleaning step has been accomplished, the dull porous surface can still contain a sizable amount of acid salts left over from the cleaning and rinsing. These salts can remain in microscopic pores throughout the surface of the substrate. Aqueous solutions containing soda ash or other suitable alkaline materials appear to pull out the acidic salts and neutralize them.

Sufficient quantities of the alkaline solution are employed to neutralize and remove any undue quantities of acid salts which remain. The alkaline material is allowed to remain in contact with the substrate for an interval sufficient to accomplish this neutralization after which it is removed completely from contact with the surface of the substrate so that no appreciable quantities of the alkaline material remain.

After the surface is thoroughly dried, it is contacted with a clear bonding agent, preferably by wiping. The bonding agent is one which is suitable for polymers, co-polymers, urethanes, epoxies or the like and is capable of drying or set-up by air or forced drying in an interval less than about 15 minutes with an interval of between about 7–10 minutes being preferred. In the preferred embodiment, the bonding agent contains an amine silane coupling agent in a solvent base. The solvent base may be any suitable material which will permit subsequent bonding between the substrate and the applied sealer subsequently applied. Preferably, the solvent material in the bonding agent is a polar liquid capable of solublizing the amine saline coupling agent. Suitable materials include aliphatic alcohols having between 1 and 10 carbon atoms with alcohols having between 2 and 6 being preferred and alcohols selected from the group consisting of isopropyl, isobutyl, ethyl, butyl, propyl, and mixtures thereof being most preferred.

The amine silane coupling agent is a suitable polymeric material capable of adhering to the surface of the substrate to which it is applied and creating or promoting the formation of chemical bonds. The chemical bonds which are created or promoted include bonds between the substrate and the polymeric material, and bonds between the polymeric material and the sealer which is applied subsequently. The polymeric material is at least partially water soluble. In general, the adhesion promoter contains between about 0.5% and about 5% by weight polymeric compound with the balance being solvent.

Material compositions suitable for use as bonding agents are commercially available from a variety of sources. One such material is commercially available from Ivar Laboratories of Martinez, California under the trade name SYLAMINE ADHESION PROMOTER. SYLAMINE ADHESION PROMOTER is composed of isopropyl alcohol containing a proprietary polymer in amounts less than 1% by weight. The material is a clear blue liquid having a boiling point of 83 degrees C (181 degrees F), a freezing point of −86 degrees C (−123 degrees F) and a specific gravity of 0.79. The material has an evaporation rate similar to isopropyl alcohol of 2.8 (n-butyl acetate=1) and a vapor pressure of 33 mm Hg at 20 degrees C. The vapor density of the material is 2.1 (air=1) and volatiles compose 99% or more of the material. Without being bound by any theory, it is believed that all or most of the volatile material evaporates upon application to the substrate, leaving the proprietary polymer deposited thereon.

The present inventive method further comprises wiping a resealant composition over the cleaned and dried outer surface of the fixture. The resealant step reseals the porosity of the surface. In a preferred embodiment, a natural or synthetic lambs wool applicator in the form of a 4"×5" pad (and/or any size applicator/pad, as desired) receives the resealing composition and is wiped over the surface to apply the solution in a thin coat. This is allowed to dry by forced (blow) or air drying (as described above). If very porous, up to four coats or more of resealer can be applied. Without being bound to any theory, it is believed that surface porosity is created as a gradual side effect of the aging process of the fixture, by the action of water, cleaners, and other material over the life of the fixture and by the action of the cleaning composition used in the method of the present invention.

It is to be understood that any suitable resealant composition may be used in the present inventive method, provided that the resealant composition is not sprayed on and otherwise meets the objectives and advantages of the present invention as set forth above. It is to be understood that suitable resealant materials will be water-based. Preferably, the material will also contain significant quantities of urethane material as the polymeric resealant component. In the preferred embodiment, the resealant composition may comprise a water based urethane copolymer. It has been found that water based materials exhibit lower production of undesireable vapors during the evaporative process. It is also theorized that the water based urethanes exhibit slower evaporation rate relative to common organic solvents. Without being bound to any theory, it is believed that he lower evaporative rates result in more intimate and permanent adhesion between the urethane material and the substrate. It is believed that the slower evaporative time permits the urethane material to interact with the chemical structure of the silane enhanced substrate while still in a solubilized or partially solubilized state. The interaction while solubilized permits and/or enhances the chemical bonding which occurs between the substrate and bonded silane and the urethane or other polymeric component of the resealant composition.

It is further preferred that the resealant composition containing the polymer or copolymer have a high solids content (preferably between about 5% and about 30%). If desired, the composition may be diluted to reduce the percentage of solids to appropriate levels.

A suitable resealant composition is commercially available from Superior Manufacturing Corp. in Detroit, Mich. under the trade name NO. 211 WBU SEALER WATER BASED. The No. 211 WBU sealer includes urethane resin (CAS# 51-79-6), acrylic resin (CAS# 9003-01-4), ethylene glycol (CAS# 111-76-2), and tri-butoxyethyl phosphate (CAS #78-51-3).

The No. 211 WBU sealer exhibited the following physical data. The substance appeared as a milky white liquid with a mild waxy odor. It had a boiling point of 212° F. with a specific gravity of 1.03. The percent, volatile by volume is 80%. Its evaporation rate (where water=1) is 1. It emulsified when mixed with water, and had a pH of 7.5. It is a stable substance but is incompatible with strong oxidizers. Hazardous decomposition products include oxides of carbon. Hazardous polymerization will not occur. Conditions to avoid including freezing of the substance. It is not a carcinogen. No respiratory protective gear is required during use, and normal ventilation is adequate when using this substance.

It has been found, quite unexpectedly, that the bond between the resealant material and the substrate actually grows stronger over time. Without being bound to any theory, it is believed that this increase in strength is due, at least in part, to the interaction between the bonding compound and the polymeric component in the resealant material. It is theorized that cross linking between the two materials and between the materials and the substrate occur slowly over time, contributing to increasing bond strength.

The present inventive method further comprises wiping a glossing composition over the dried, resealed outer surface. The glossing composition is applied to substantially restore the surface to the factory gloss. In a preferred embodiment, the lambs wool applicator (described above) is used to apply the glossing composition. In the preferred embodiment, between about 3–6 or more coats of the glossing composition is applied. After each coat of glossing composition, a drying step of forced (blow) or air drying (as described herein above) is employed.

It is to be understood that any suitable glossing composition may be used in the present inventive method, provided that the glossing composition is not sprayed on and otherwise meets the objectives and advantages of the present invention as set forth above. In the preferred embodiment, the glossing composition may comprise a water based, metal interlocking urethane or acrylic copolymer. Further preferred is such a copolymer having a high solids content (preferably between about 5% and about 30%). If desired, the composition may be diluted to reduce the percentage of solids.

A suitable glossing composition is commercially available from Superior Manufacturing Corp. in Detroit, Mich. under the trade name NO. 231 ONE COAT FINISH. The No. 231 One Coat Finish includes diethylene glycol monomethyl ether (CAS# 111-90-0), tributoxy ethyl phosphate (CAS# 78-51-3), wax emulsion (CAS# 9002-88-4), alkali soluble resin (CAS# 68911-89-7), and acrylic polymer emulsion (CAS# 62180-77-2).

The No. 231 finish exhibited the following physical data. The substance appeared as a milky white liquid with a waxy odor. It had a boiling point of 212° F. with a specific gravity of 1.02. The percent, volatile by volume is 75%. Its evaporation rate with water was 1. It emulsified when mixed with water, and has a pH of 8.9. It is a stable substance but is incompatible with strong oxidizers. Hazardous decomposition products include oxides of carbon. Hazardous polymerization will not occur. Conditions to avoid include freezing of the substance. It is not a carcinogen. No respiratory protective gear is required during use, and normal ventilation is adequate when using this substance.

At the completion of the drying of the last glossing step, the surface, fixture, etc., may be placed into immediate use.

The gloss/glazing composition is a gloss coat and generally does not include color. However, it is contemplated as being within the purview of the present invention to include color. The present inventive method generally will not repair chips or portions of the surface which is worn down to the underlying bare metal or underlying substrate but provides an effective and relatively inexpensive method for restoring surfaces which are dulled and unattractive.

The method of the present invention further contemplates the additional step of applying a finish coat over the gloss composition in order to further increase durability and useful life of the fixture. Examples of suitable extender materials are those commercially available under the trade name LIFEGUARD from Aldon Chemicals, and from U.S. Products under the trade name THERMOSHIELD. In the present application, these materials are employed as sacrificial coatings. Preferably, the gloss coat material is a water based polymeric solution in which the polymeric component is compatible with the polymeric material employed in the resealant layer. The materials of choice is a water based urethane.

In order to achieve an even higher level of gloss or to remove any additional contaminants which may remain on adhered to the surface of the fixture after treatment, the final product may be buffed either with a high speed polisher or by hand with a suitable buff pad such as a white synthetic pad.

The restored surface as achieved by the method of the present invention substantially resists chipping, peeling, yellowing or fading thus can actually prolong the useful life of the associated fixture and provide significant increases in esthetic quality. The resulting treated surface such as a tub surface is resistant to degradation due to extremes in temperature as would be seen in tubs and other water-containing or contacting surfaces as well as being resistant to wear from harsh cleaners and the various other compounds which may come into contact with the surface over its useful life. Additionally, the method of the present invention provides a means for applying a resealant coat and final gloss coat which do not require buffing rubbing or other surface enhancement techniques to achieve an even, smooth, aesthetically pleasing surface. This is in sharp contrast to the other known restorative processes.

Additionally, the exceptional results of the method of the present invention is due in no small part to the careful integration of all main process steps. The careful interaction of the compounds and steps yield the superior surface finish of the present invention.

To further illustrate the method of the present invention, the following example is given. It is to be understood that these examples are provided for illustrative purposes and are not to be construed as limiting the scope of the present invention.

EXAMPLE 1

A porcelain bathtub was treated according to the method of the present invention. Prior to treatment according to the present invention, the tub had visible staining and dullness. Additionally the tub had old, deteriorated and peeling non-slip strips are on its bottom surface as well as peeling of the porcelain material at and about the drain.

The tub was stripped of prior reglazing material, cleaned by applying a powder abrasive consisting essentially of oxalic acid-dihydrate with some water; and scrubbing the tub. The tub was then rinsed with water. This removed the stains the original porcelain. The tub was then dried with a blow dryer in about 3–5 minutes resulting in a dull, cleaned surface.

A water based, urethane copolymer resealant composition, namely NO. 211 WBU SEALER WATER BASED, commercially available from Superior Manufacturing Corp. in Detroit, Michigan, was applied on a 4"×5" lambs wool applicator pad, and was wiped over the surface to apply the solution in a thin coat. This was blow dried for about 3–5 minutes. The resealing and drying steps were repeated once.

A glossing composition was applied over the dried, resealed outer surface in the following manner. A water based, metal interlocking urethane copolymer, namely NO. 231 ONE COAT FINISH, commercially available from Superior Manufacturing Corp. in Detroit, Mich., was applied on a 4"×5" lambs wool applicator pad, and was wiped over the surface to apply the solution in a thin coat. This was blow dried for about 3–5 minutes. The glazing and drying steps were repeated twice. After the last drying step, the bathtub was ready for immediate use. The resulting surface of the tub treated according to the present invention was visually inspected and appeared ,as a clean, bright and high gloss surface, substantially restored to the factory gloss.

What is claimed is:

1. A method for restoring the outer surface of a substrate comprising the steps of:

cleaning the outer surface to remove stains;

wiping a resealant composition over the dried outer surface, the resealant composition containing a water-based urethane co-polymer;

wiping a glossing composition over the dried resealed outer surface, the glossing composition consists essentially of a water-based acrylate copolymer; and permitting the outer surface with the sealing and glossing compositions applied thereon to form a water resistant surface;

wherein the substrate to be restored is a hard glossy material selected from the group consisting of synthetic enamel, fiberglass, ceramic, porcelain, and mixture thereof.

2. The method of claim 1 wherein the cleaning step comprises:

applying a cleaning composition to the outer surface to be restored, the cleaning composition being capable of effecting the removal stains, marks, paint, dirt, grime or the like, the application of the cleaning composition occurring at least once;

mechanically manipulating the applied cleaning composition under pressure; and removing the applied cleaning composition from contact with the surface to be restored.

3. The method of claim 2 wherein the cleaning step further comprises:

contacting the surface to be restored with a quantity of at least one aqueous solution sufficient to remove the cleaning composition from contact with the surface; and allowing the surface to dry after contact with the at least one aqueous solution.

4. The method of claim 3 wherein the drying step is accomplished at elevated temperature with blowing.

5. The method of claim 2 wherein the cleaning composition applied to the surface to be restored comprises:

at least one abrasive compound, the abrasive compound selected from the group consisting of oxalic ad dihydrate, kaolin, pumice, diatomite, tripoli, siliceous clay, silicon dioxide, and mixtures thereof;

at least one acidic material selected from the group consisting of hydrochloric acid, hydrofluoric acid, nitric acid, hydrochlorous acid, and mixtures thereof; and water.

6. The method of claim 5 wherein the abrasive compound is oxalic acid dihydrate present as a granular powder.

7. The method of claim 5 wherein the cleaning composition applied to the surface to be restored is an aqueous gel consisting essentially of an aqueous acidic thixotropic composition having a viscosity of 2000 to 10,000 centipoise.

8. The method of claim 5 wherein the cleaning composition applied to the surface to be restored is an aqueous gel consisting essentially of an aqueous acidic thixotropic composition having a viscosity of 2500 to 7000 centipoise and consists essentially of:

between about 0.5 percent and about 6.0 percent by weight of a hydrated aluminum silicate substantially free from inert mineral impurities;

between about 0.1 percent and about 3.0 percent by weight of at least one of an amphoteric material and a highly alkoxylated block copolymer;

between about 0.1 percent and about 5.0 percent by weight of a nonionic surfactant selected from the group consisting of polyoxyethylene derivatives of higher alcohols and polyethylene glycol ethers of linear alcohol;

acid present in an amount sufficient to render a pH in the range of about 0.9 to about 3.5;

between about 5.0 percent and about 50.0 percent by weight of an acid-inert abrasive, the abrasive having an average particle size from about 40 to about 400 mesh;

between about 1.0 percent and about 20.0 percent by weight of a cleaning solvent;

between about 0.01 percent and about 10.0 percent by weight of an acid or acid derivative selected from the group consisting of oxalic acid, citric acid, glycolic acid, sulfamic acid, hydrochloric acid, hydrofluoric acid, phosphoric acid oxalic acid-dihydrate, citric acid-dihydrate, glycolic acid dihydrate, sulfamic acid-dihydrate, and mixtures thereof; and water present in an amount sufficient to make 100 percent, wherein the hydrated aluminum silicate has sufficient cation exchange sites available for interaction with the amphoteric material to promote achievement and stabilization of the viscosity in the range 2000 to 10,000 cps.

9. The method of claim 8 wherein the hydrated aluminum silicate is selected from the group consisting of montmorillonite clay, materials belonging to smectite class of clay minerals, and mixtures thereof wherein the hydrated aluminum silicate has a cation exchange capacity of 80 to 120 meq/100 g.

10. The method of claim 8 wherein the amphoteric material is selected from the group consisting of alkyl dimethyl amine oxides, alkyl amido amine oxides, betaine derivatives, polymers produced from block alkoxylated block copolymers, and mixtures thereof.

11. The method of claim 8 wherein the solvent is selected from the group consisting of dipropylene glycol methyl ether, diethylene glycol monobutyl ether, ethylene monobutyl ether, and mixtures thereof.

12. The method of claim 1 wherein the resealant composition contains between about 15% and about 25% by weight urethane copolymer.

13. The method of claim 1 wherein the glossing composition is a water-based metal interlocking copolymer.

14. A method for restoring the outer surface of a substrate comprising the steps of:

rendering the outer surface to be restored amenable to contact by a polymeric resealant composition, wherein the outer surface is contacted by a composition capable of cleaning the outer surface and producing an outermost surface layer characterized by a porous outermost region;

applying a resealant composition over the outer surface, the resealant composition capable of penetrating and adhering to porosities in the outer surface, the resealant composition consisting essentially of a water-based urethane co-polymer;

applying a glossing composition over e resealed outer surface, the glossing composition comprising a water-based copolymer capable of adhesion to the applied resealant material in an essentially uniform manner, the copolymer selected from the group consisting of metal interlocking urethane, acrylates and mixtures thereof; and wherein the outer surface of the hard substrate to be restored is a hard glossy material selected from the group consisting of synthetic enamel, fiberglass, ceramic, porcelain and mixtures thereof.

15. The method of claim 14 further comprising the step of applying an amine silane coupling agent to the outer surface subsequent to contact by the cleaning composition.

* * * * *